United States Patent [19]

Kahmann

[11] 3,945,576

[45] Mar. 23, 1976

[54] STOCK PULPER

[75] Inventor: Albrecht Kahmann, Weingarten, Germany

[73] Assignee: Escher Wyss GmbH, Ravensburg, Germany

[22] Filed: Sept. 5, 1974

[21] Appl. No.: 503,251

[30] Foreign Application Priority Data

Sept. 11, 1973 Switzerland ..... 13013/73

[52] U.S. Cl. ..... 241/46.17; 241/46.11; 241/84

[51] Int. Cl.[2] ..... B02C 23/36

[58] Field of Search ..... 241/46.11, 46.17, 69, 73, 241/84

[56] References Cited

UNITED STATES PATENTS 2,384,326 9/1945 Martindale ..... 241/69

FOREIGN PATENTS OR APPLICATIONS 674,373 6/1952 United Kingdom ..... 241/46.11

*Primary Examiner*—Roy Lake
*Assistant Examiner*—E. F. Desmond
*Attorney, Agent, or Firm*—Kenyon & Kenyon Reilly Carr & Chapin

[57] ABSTRACT

The stock pulper has a container in which the screen has a dimensional component disposed axially of the container to receive an inwardly directed radial flow of the stock suspension. The screen can be cylindrical or conical. Breaker dogs are also fixedly mounted in the container to extend to the ends of the rotor arms.

8 Claims, 4 Drawing Figures

STOCK PULPER

Figure 1:
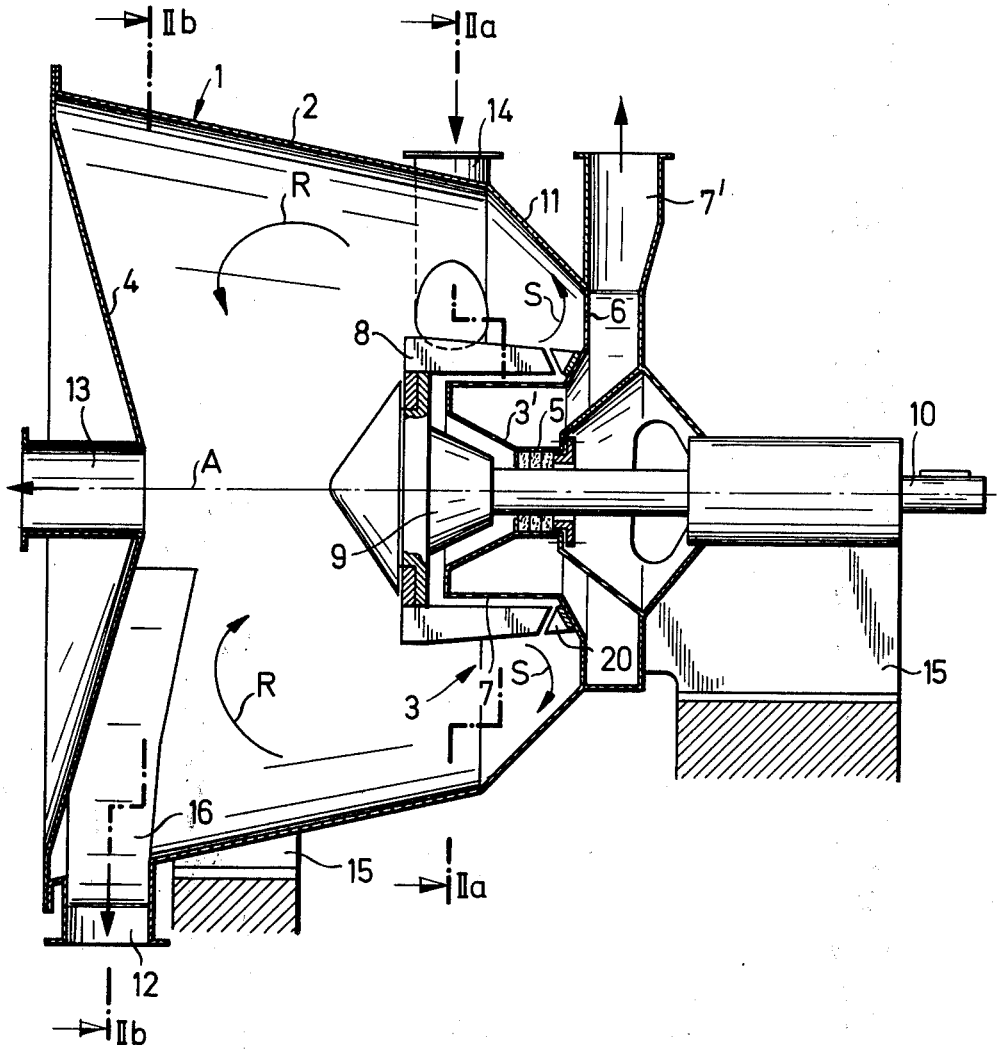

This invention relates to a stock pulper.

Heretofore, stock pulpers for pulping and sorting waste paper have usually been constructed with a container substantially in the form of a body of revolution to accommodate a stock suspension, an axially mounted rotor having arms to impart a rotational and circulatory motion to the contents of the container, and also a sieve or screen which is followed by a discharge pipe for good stock. Stock pulpers of this type serve for pulping and sorting waste paper which is used in the manufacture of paper. The good stock can be used directly for the manufacture of new paper. Usually, light impurities, as for example synthetic plastics foils, are removed through an outlet opening disposed axially of the container. Also, an outlet opening is usually formed in the circumferential wall for the removal of heavy impurities, as for example metallic parts.

It is an object of this invention to improve the sorting action of a stock pulper of the above type.

It is another object of the invention to reduce the wear on the screen of a stock pulper which is caused particularly by heavy impurities.

Briefly, the invention provides a stock pulper comprising a container for receiving a stock suspension, a rotor, a screen and a discharge pipe. The container is in the form of a body of revolution about a longitudinal axis while the rotor is rotatably mounted within the container on the axis of the container. The rotor has a plurality of arms or blades for imparting a rotational and circulatory motion to the stock suspension in the container. Also, the screen is mounted within the container and has a dimensional component disposed axially of the container to receive an inwardly directed radial flow of the suspension and to pass good stock therethrough. The discharge pipe is connected to the container downstream of the screen relative to a flow of the good stock.

The arms of the rotor are spaced slightly from the screen to define a shearing zone therebetween in which the suspension can be processed in known manner.

The effect which is achieved by the flow of the stock suspension through the screen with a radial component directed towards the axis of the rotor is that the stock has to flow towards and through the screen against the centrifugal force. In this way, the sorting action and more particularly the separation of heavy parts is assisted. The centrifugal force prevents the heavy parts reaching the shearing zone existing between the rotor and the screen. As a consequence, the wear on these comparatively expensive elements is substantially reduced.

In one embodiment, the screen is cylindrical, the flow through the screen passing from outside inwardly. This form of screen can be easily manufactured and is particularly effective as regards the influence of the centrifugal force.

In another embodiment, the screen is conical. In this case, the flow through the screen is from outside and inwardly. If the apex of the conical screen is directly into the interior of the container, this results in certain circumstances in technical flow advantages being obtained with respect to the circulatory flow of the suspension in the container.

A plurality of breaker dogs or cams may also be fixedly mounted within the container opposite the ends of the arms of the rotor to assist in the breaking up of wet-strength papers with an advantageous utilization of the circulatory flow of the stock suspension in the container.

Figure 2A:
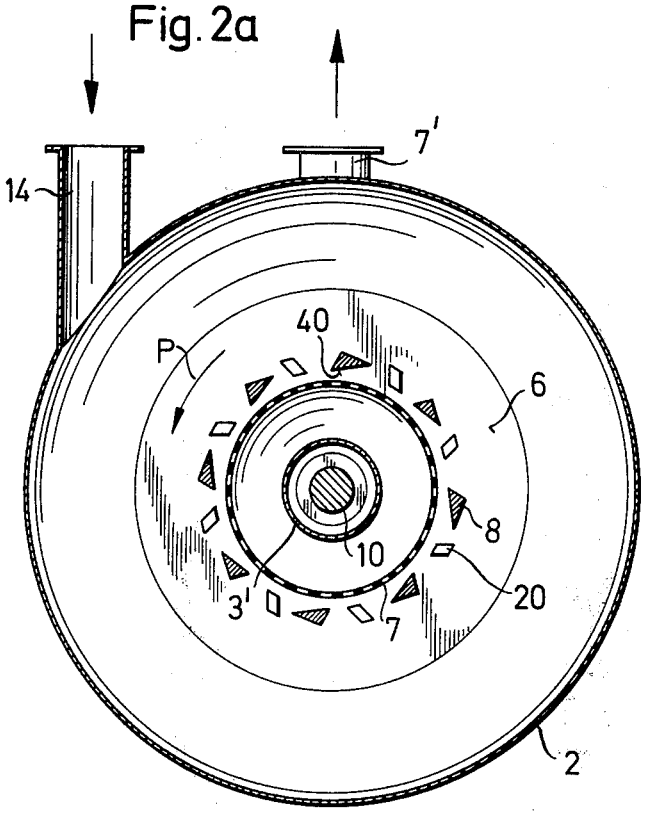
Figure 2B:
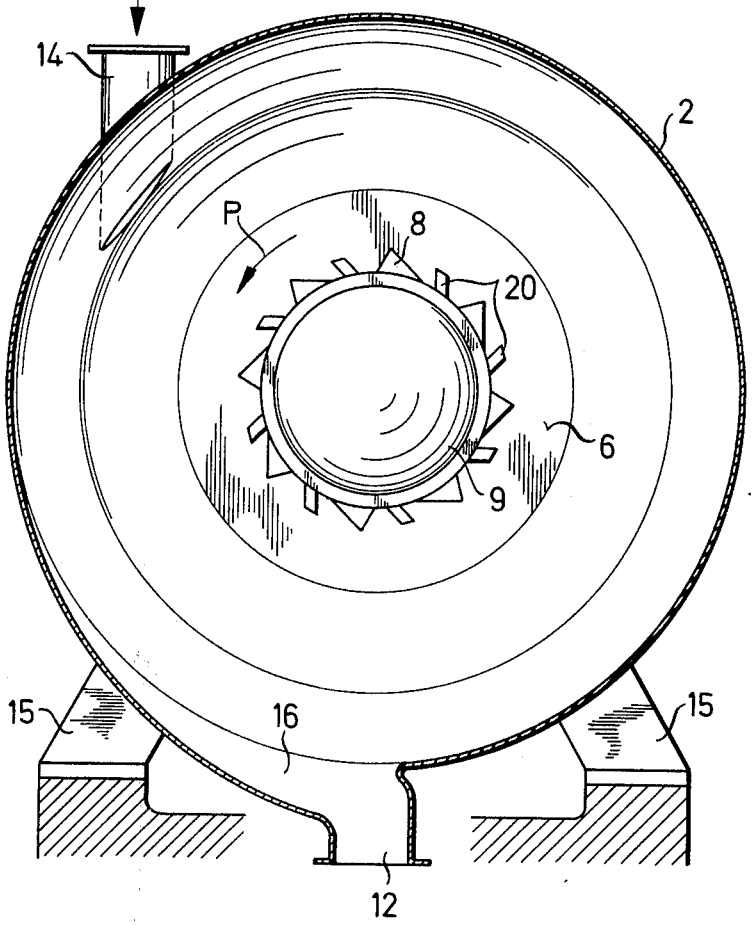

These and other objects and advantages of the invention will become more apparent from the following detailed description and appended claims taken in conjunction with the accompanying drawings in which:

FIG. 1 illustrates an axial section of a stock pulper according to the invention;

FIG. 2*a* illustrates a view taken on line II*a*—II*a* of FIG. 1;

FIG. 2*b* illustrates a view taken on line II*b*—II*b* of FIG. 1; and

Figure 3:
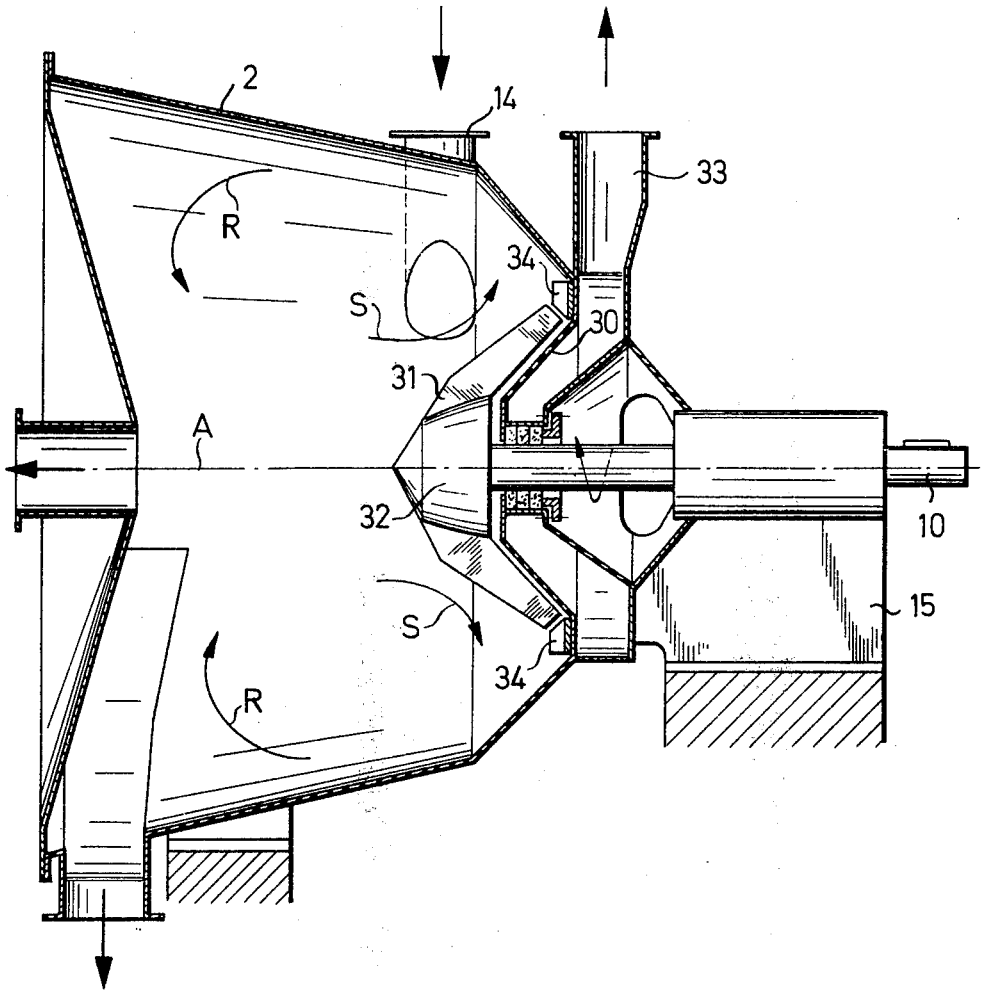

FIG. 3 illustrates a section corresponding to FIG. 1 of another constructional form of the screen and rotor according to the invention.

Referring to FIGS. 1, 2*a* and 2*b*, a stock pulper has a container 1 in the form of a body of revolution about a horizontal axis A with a conical circumferential wall 2, a front wall 3 and a likewise conical end wall 4. The front wall 3 is formed by a front wall 3′ of a bearing housing 5 and also a wall section 6. In addition, a cylindrical screen 7 is situated between the wall 3′ and the wall section 6 and a discharge pipe 7′ for good stock is connected to the container 1 downstream of the screen 7.

Referring to FIG. 1, a rotor 9 is rotatably mounted in the container 1 by means of a suitable bearing in the bearing housing 5. The rotor 8 is mounted on the axis A and is driven through a shaft 10 extending through the front end of the container 1. The rotor 9 has arms or blades 8 which are movable over the screen 7 and are slightly spaced from the screen 7 to define a shearing zone. As shown, a section 11 of the circumferential wall 2 adjacent the front wall 3 has a larger cone angle than the remainder of the wall 2 with both so arranged to have a diameter increasing in the direction towards the end wall 4. The conical end wall 4 is arranged with its cone apex directed into the interior of the container 1.

A discharge pipe 12 for heavy impurities is arranged as is known in the section of the circumferential wall 2 which adjoins the end wall 4. Similarly, a discharge opening 13 for carrying away specifically light impurities, as for example synthetic plastic parts and foils, is arranged in the end wall 4 opposite the rotor 9 in the direction of the axis A.

As will be seen particularly from FIG. 2*a*, the container 1 is provided with an inlet pipe 14 for waste paper which is fixed on the circumferential wall 2. In addition, as shown in FIGS. 1 and 2*b*, the container 1 is provided with supports 15 for being set up on a floor.

Referring to FIG. 2*b*, a compartment 16 extends over a part of the circumference of the container 1 for the removal of the heavy impurities. The discharge pipe 12 is in this case disposed at the point of the compartment 16 having the largest depth.

If the rotor 9 is rotated with the container 1 full, there is first established a rotation of the contents in the direction of rotation of the rotor (arrow P) and secondly a circulatory motion in the direction of the arrows R in FIG. 1. By virtue of these movements, the mass of waste paper pulped by the rotor 9 is subjected to the action of centrifugal force, whereby a sorting effect is established. Because of the slope of the circumferential wall 2 and of the section 11, heavy parts quickly pass into the angular zone between the circumferential wall 2 and the end wall 4 and these parts are collected in the compartment 16. Light impurities accumulate along the axis A of the container 1 and can be discharged through the outlet opening 13.

The good stock, which flows through the screen 7 into the pipe 7′ and is extracted through the pipe 7 from the stock pulper, has to flow through the screen 7 in an inward direction against the action of the centrifugal force. As a consequence, the separating action on the heavy substances is assisted, so that they are unable in practice to reach the shearing zone between the arms 8 of the rotor 9 and the screen 7. As a consequence, the comparatively costly screen is protected against rapid wear.

As will also be seen from FIGS. 1 and 2*a*, breaker cams or dogs 20 can be arranged in a fixed position in the container 1 in the region of the ends of the arms 8 of the rotor 9. These breaker dogs 20 assist the tearing of particularly stubborn lumps of paper, as for example lumps of wet-strength papers. In this case, in order to feed the lumps between the arms 8 of the rotor 9 and the breaker dogs 20 use is made of the circulatory flow which extends in this region in the direction of arrows S.

Referring to FIG. 3, wherein like reference characters indicate like parts as above, the screen 30 is alternatively made conical with the apex of the cone being directed into the interior of the container. As above, the arms 31 of a rotor 32 extend along the screen 30. Following the screen 30 is a pipe 33 for the removal of the good stock. In this example, the screen 30 forms the front wall of the container 1.

In the embodiment of FIG. 3, an advantageous flow around the screen 30 is established by the circulatory flow R, S in the container 1. This is able in certain circumstances to have a favorable effect on the functioning of the stock pulper. It is understood that fixed breaker dogs 34 can also be arranged in the region of the ends of the arms 31 of the rotor 32.

It is also possible, in principle, for the screen 30 to be arranged in the reverse position, i.e., with its cone apex outwardly. In this case, with somewhat less satisfactory flow around the screen, an improved protection is obtained for the screen against heavy parts which are to be separated out.

In both constructional forms given by way of example, the rotor 9 or 32 has arms 8 and 31, respectively, which are moved along the screen. As will be clear from the section of the arms 8 in FIG. 2*a*, the arms have rearwardly rising surfaces 40, which in known manner result in pulsation surges of the stock flow with the movement of the rotor and in this way prevent any clogging of the screen. it is understood that these pulsations can also be produced by other means, for example, by pulsator arms movable in known manner on the inside of the screen. In such a case, the arms 8 and 31 only serve to produce the rotation and circulatory motion of the stock and do not have to extend along the screen, at least not along its full extent.

What is claimed is:

1. A stock pulper comprising a container for receiving a stock suspension, said container being in the form of a body of revolution about a horizontal longitudinal axis with an increasing diameter from one end towards an opposite end;

a rotor rotatably mounted within said container on said axis at said one end and having a plurality of arms for imparting a rotational and circulatory motion to a stock suspension in said container;

a discharge pipe in said container at said opposite end for discharging heavy impurities from the stock suspension during rotation of said rotor;

a screen within said container at said one end, said screen having a dimensional component disposed axially of said container to receive an inwardly directed radial flow of the stock suspension and to pass good stock therethrough; and a discharge pipe connected to said container downstream of said screen relative to a flow of the good stock.

2. A stock pulper as set forth in claim 1 wherein said screen is cylindrical.

3. A stock pulper as set forth in claim 1 wherein said screen is conical.

4. A stock pulper as set forth in claim 3 wherein said conical screen has an apex directed into the interior of said container.

5. A stock pulper as set forth in claim 1 which further comprises a plurality of breaker dogs fixedly mounted within said container and said arms extend to the vicinity of said dogs.

6. A stock pulper as set forth in claim 1 wherein said arms are spaced slightly from said screen to define a shearing zone therebetween.

7. A stock pulper comprising a container for receiving a stock suspension, said container being in the form of a body of revolution about a longitudinal axis;

a plurality of breaker dogs fixedly mounted within said container;

a rotor rotatably mounted within said container on said axis and having a plurality of arms extending to the vicinity of said dogs for imparting a rotational and circulatory motion to a stock suspension in said container;

a screen within said container with a dimensional component disposed axially of said container to receive an inwardly directed radial flow of the stock suspension and to pass good stock therethrough; and a discharge pipe connected to said container downstream of said screen relative to a flow of the good stock.

8. A stock pulper comprising a container for receiving a stock suspension, said container being in the form of a body of revolution about a longitudinal axis;

a rotor rotatably mounted within said container on said axis and having a plurality of arms for imparting a rotational and circulatory motion to a stock suspension in said container;

a screen within said container with a dimensional component disposed axially of said container to receive an inwardly directed radial flow of the stock suspension and to pass good stock therethrough, said screen being spaced slightly from said rotor arms to define a shearing zone therebetween; and a discharging pipe connected to said container downstream of said screen relative to a flow of the good stock.

* * * * *